US008660459B2

(12) United States Patent
Azuma et al.

(10) Patent No.: US 8,660,459 B2
(45) Date of Patent: Feb. 25, 2014

(54) DRUM UNIT HAVING SIDE SEALS AND IMAGE-FORMING APPARATUS INCLUDING THE SAME

(75) Inventors: Jun Azuma, Osaka (JP); Kensuke Okawa, Osaka (JP); Eiji Morimoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 1038 days.

(21) Appl. No.: 12/620,704

(22) Filed: Nov. 18, 2009

(65) Prior Publication Data

US 2010/0189482 A1 Jul. 29, 2010

(30) Foreign Application Priority Data

Jan. 26, 2009 (JP) ..... 2009-013895

(51) Int. Cl.
*G03G 15/08* (2006.01)
*G03G 21/00* (2006.01)
*G03G 21/18* (2006.01)

(52) U.S. Cl.
CPC ..... *G03G 21/1828* (2013.01); *G03G 21/1832* (2013.01); *G03G 21/0011* (2013.01)
USPC ..... 399/102; 399/350

(58) Field of Classification Search
CPC ..... G03G 15/0817; G03G 15/0898; G03G 15/0942; G03G 21/1832
USPC ..... 399/102, 103, 105, 159, 350, 351
See application file for complete search history.

(56) References Cited

U.S. PATENT DOCUMENTS

| | | | | |
|---|---|---|---|---|
| 5,502,547 | A * | 3/1996 | Shirai | 399/102 |
| 6,118,958 | A * | 9/2000 | Nagashima | 399/105 |
| 2007/0042281 | A1 * | 2/2007 | Orito et al. | |

FOREIGN PATENT DOCUMENTS

| | | | |
|---|---|---|---|
| JP | 01-185587 | | 7/1989 |
| JP | 04-181280 | | 6/1992 |
| JP | 05-061390 | | 3/1993 |
| JP | 07005794 | A * | 1/1995 |
| JP | 07234609 | A * | 9/1995 |
| JP | 2008-139372 | | 6/2008 |

* cited by examiner

*Primary Examiner* — Walter L Lindsay, Jr.
*Assistant Examiner* — Milton Gonzalez
(74) *Attorney, Agent, or Firm* — Frommer Lawrence & Haug LLP

(57) ABSTRACT

In some embodiments, a drum unit may include an electrophotographic photosensitive member having a base member and a photosensitive layer on the base member. An embodiment may include a cleaning blade configured to abut the photosensitive layer to remove a developer remaining on the photosensitive layer of the electrophotographic photosensitive member. Some embodiments may include side seals disposed at both ends of the cleaning blade to inhibit leakage of the developer. In some embodiments, a portion of a side seal may be in contact with at least a portion of the surface and an end face of the photosensitive layer.

12 Claims, 4 Drawing Sheets

DRUM UNIT HAVING SIDE SEALS AND IMAGE-FORMING APPARATUS INCLUDING THE SAME

INCORPORATION BY REFERENCE

This application is based upon and claims the benefit of priority from the corresponding Japanese Patent application No. 2009-13895, filed Jan. 26, 2009, the entire content of which is incorporated herein by reference.

FIELD OF THE INVENTION

The present invention generally relates to drum units and image-forming apparatuses including the drum units. In particular, it relates to a drum unit capable of stably suppressing scattering of toners from ends of a cleaning blade, and an image-forming apparatus including the drum unit.

BACKGROUND OF THE INVENTION

According to existing electrophotographic techniques, images are formed by transferring toner images developed on surfaces of electrophotographic photosensitive members onto paper or the like.

Even after toner images have been transferred onto paper or the like, some toner usually remains on surfaces of the electrophotographic photosensitive members and thus removal of the residual toner becomes necessary.

In order to remove the residual toner, a cleaning section that scrapes off the residual toner by pressing a cleaning blade composed of an elastic material such as rubber against a surface of an electrophotographic photosensitive member and recovers the residual toner that has been scraped off into an opening facing the electrophotographic photosensitive member has been widely employed.

However, when such a cleaning section is employed, some of the residual toner that has been scraped off tends to scatter from both ends of the cleaning blade instead of being recovered at the opening.

In order to effectively suppress scattering of the residual toner from both ends of the cleaning blade, a cleaning section (first cleaning section) has been proposed in which side seals are integrally attached to both ends of the cleaning blade.

Another cleaning section (second cleaning section) has also been proposed which includes a cleaning blade constituted by a smooth and flat porous main body composed of a fluorocarbon resin having good slidability and a sponge-like elastic body superimposed on the porous main body. With this cleaning section, deterioration of the side seals rarely occurs even when the side seals are pressed against the surface of the electrophotographic photosensitive member and a good sealing function is achieved.

However, in the first cleaning section, although the cleaning blade and the side seals are integrated with one another, their contact pressures against the surface of the electrophotographic photosensitive member differ and the balance between the respective contact pressures is left unadjusted. This causes the cleaning blade and the side seals to easily curl up, thereby only accelerating toner scattering. In the second cleaning section, because the slidability of a portion of the side seal where the side seal contacts the electrophotographic photosensitive member has been enhanced, the residual toner easily slips beneath the side seals. This renders it difficult to suppress toner scattering.

SUMMARY OF THE INVENTION

Various embodiments of the present invention provide a drum unit which is capable of stably suppressing scattering of toner from ends of a cleaning blade. Further, some embodiments may provide an image-forming apparatus which includes the drum unit.

Some embodiments may provide a drum unit that includes an electrophotographic photosensitive member, a cleaning blade, and/or side seals. In an embodiment, an electrophotographic photosensitive member may include a base member and a photosensitive layer on the base member. An embodiment of a cleaning blade may be configured to abut the photosensitive layer to remove a developer remaining on the photosensitive layer of the electrophotographic photosensitive member. In some embodiments, side seals respectively may be disposed at both ends of the cleaning blade to inhibit leakage of the developer. At least one of the side seals may be in contact with a surface and an end face of the photosensitive layer.

In an embodiment, an image-forming apparatus may include an electrophotographic photosensitive member, a charging portion, an exposing portion, a developing portion, a transferring portion, a cleaning blade, and side seals. In some embodiments, an electrophotographic photosensitive member may include a base member and a photosensitive layer on the base member. In an embodiment, a charging portion may be configured to charge the electrophotographic photosensitive member. An embodiment of an exposing portion may be configured to form an electrostatic latent image on the electrophotographic photosensitive member by exposing the electrophotographic photosensitive member charged by the charging portion. In some embodiments, a developing portion may be configured to form a developer image on the electrophotographic photosensitive member by developing with a developer the electrostatic latent image formed on the electrophotographic photosensitive member by the exposing portion. In an embodiment, a transferring portion may be configured to transfer the developer image formed on the electrophotographic photosensitive member by the developing portion onto a recording medium. Some embodiments may include a cleaning blade which may be configured to contact the photosensitive layer to remove developer that may remain on the photosensitive layer of the electrophotographic photosensitive member. An embodiment may include side seals respectively disposed at both ends of the cleaning blade to inhibit leakage of the developer. At least one of the side seals may be in contact with a surface and an end face of the photosensitive layer.

The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents. Embodiments of a drum unit and an image-forming apparatus including the drum unit will now be described in detail.

Figure 1:
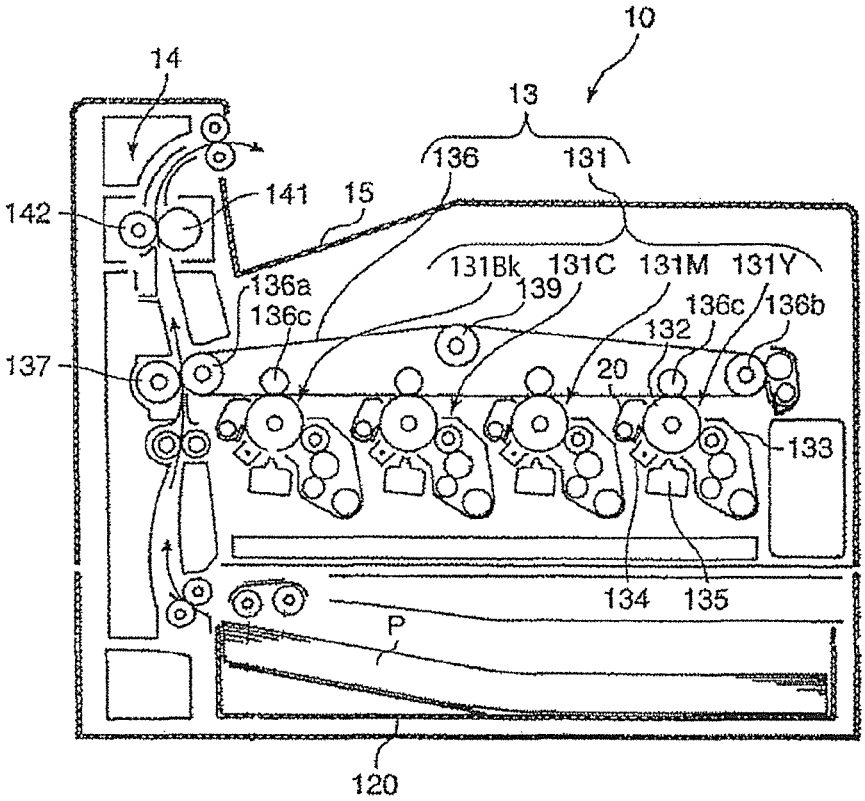
FIG. 1 is a diagram illustrating a drum unit according to an embodiment of the present invention and an image-forming apparatus including the drum unit.

As shown in FIG. 1, an embodiment of image-forming section 13 of image-forming apparatus 10 may include image-forming unit 131, intermediate transfer belt 136 having a surface (contact surface) onto which toner images, i.e., developer images, are transferred by image-forming unit 131 (first transfer), and second transfer section 137 configured to transfer the developer images on intermediate transfer belt 136 onto a recording medium P fed from paper feed cassette 120 (second transfer).

Image-forming unit 131 includes yellow unit 131Y, magenta unit 131M, cyan unit 131C, and black unit 131Bk sequentially arranged in that order from the upstream side (the right-hand side in FIG. 1) to the downstream side of image-forming apparatus 10.

Each of units 131Y, 131M, 131C, and 131Bk includes electrophotographic photosensitive member 132. In some embodiment, electrophotographic phostosensitive members may be capable of rotating. For example, electrophotographic phostosensitive members may rotate counterclockwise. In some embodiments, electrophotographic phostosensitive members may serve as an image supporting body. As shown in FIG. 1, electrophotographic photosensitive member 132 may be disposed at the center of the unit.

As shown in FIG. 1, charging portion 134, exposing portion 135, and developing portion 133 may be sequentially arranged around electrophotographic photosensitive member 132 in that order from the upstream side of the rotation direction.

In some embodiments, charging portion 134 uniformly charges a peripheral surface of electrophotographic photosensitive member 132 rotating about a designated axis.

In an embodiment, the charging portion may include any device capable of treating a surface using an electrical corona discharge. For example, the charging portion may include, but is not limited to electrodes, such as roller electrodes, scorotron chargers, or any other charger known in the art. As shown in FIG. 1, charging portion 134 may include scorotron chargers.

As shown in FIG. 1, exposing portion 135 may be a laser scan unit. Based on image data input from image-reading devices and the like, exposing portion 135 may apply a laser beam onto the peripheral surface of electrophotographic photosensitive member 132 uniformly charged by charging portion 134 to form electrostatic latent images on electrophotographic photosensitive member 132 by exposure on the basis of the image data.

Developing portion 133 may supply developer to the peripheral surface of electrophotographic photosensitive member 132. Electrostatic latent images may be formed on the electrophotographic photosensitive member such that developer images are formed based on the image data.

Developer images formed as described above may be transferred onto intermediate transfer belt 136 (first transfer).

As shown in FIG. 1, intermediate transfer belt 136 is an endless belt-like rotating member and may be stretched across a plurality of rollers such as driving roller 136*b*, backup roller 136*a*, first transfer portion 136*c*, and tension roller 139 so that the surface (contact surface) of intermediate transfer belt 136 abuts the peripheral surfaces of the electrophotographic photosensitive members 132.

In an embodiment, intermediate transfer belt 136 may be configured to rotate continuously by the plurality of rollers described above. In some embodiments, intermediate transfer belt 136 may rotate while being pressed against electrophotographic photosensitive member 132 by first transfer portion 136*c*. As shown in FIG. 1, first transfer portion 136*c* may face electrophotographic photosensitive member 132.

First transfer portion 136*c* applies a first transfer bias (the polarity opposite to the charge polarity of the developer) to intermediate transfer belt 136.

In some embodiments, the developer images formed on respective electrophotographic photosensitive members 132 may be sequentially transferred onto intermediate transfer belt 136 rotating in a particular direction by being driven by driving roller 136*b* between electrophotographic photosensitive member 132 and first transfer portion 136*c* and are superimposed on one another on intermediate transfer belt 136 (first transfer).

In an embodiment, second transfer section 137 applies a second transfer bias having a polarity opposite to that of the developer images to paper P.

As a result, the developer images transferred onto intermediate transfer belt 136 by the first transfer may be transferred onto the paper P between second transfer section 137 and backup roller 136*a*, and color transferred images are formed on the paper P.

As shown in FIG. 1, an embodiment of fixing section 14 may perform a fixing process on the images transferred by image-forming section 13 onto the paper P. As depicted fixing section 14 may include heating roller 141 heated with an electrical heating element and pressurizing roller 142 having a peripheral surface abutting and pressed against a peripheral surface of the heating roller 141. In some embodiments, pressurizing roller 142 may be positioned to face heating roller 141.

The images transferred to the paper P by second transfer section 137 in the image-forming section 13 are fixed on the paper P by a thermal fixing process as the paper P passes between heating roller 141 and pressurizing roller 142.

The paper P subjected to the fixing process is discharged to a paper discharge section 15.

After the first transfer of the developer images formed on electrophotographic photosensitive member 132 onto intermediate transfer belt 136, residual toner may remain on electrophotographic photosensitive member 132.

The residual toner may be removed by cleaning section 20. The cleaning section and the electrophotographic photosensitive member will now be described in detail.

Figure 2A:
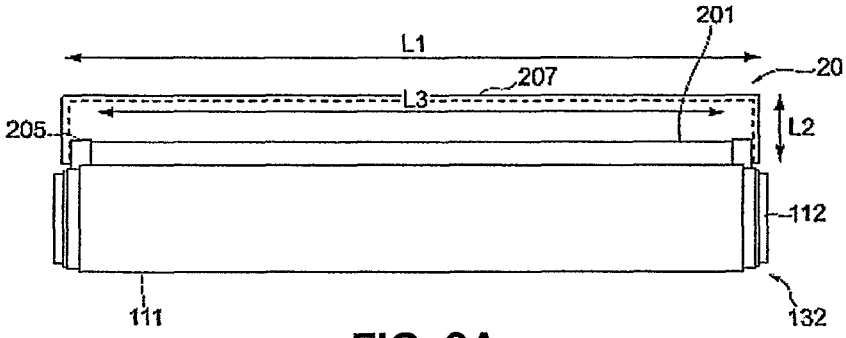
FIG. 2A is a diagram illustrating a cleaning section and an electrophotographic photosensitive member of the drum unit.
Figure 2B:
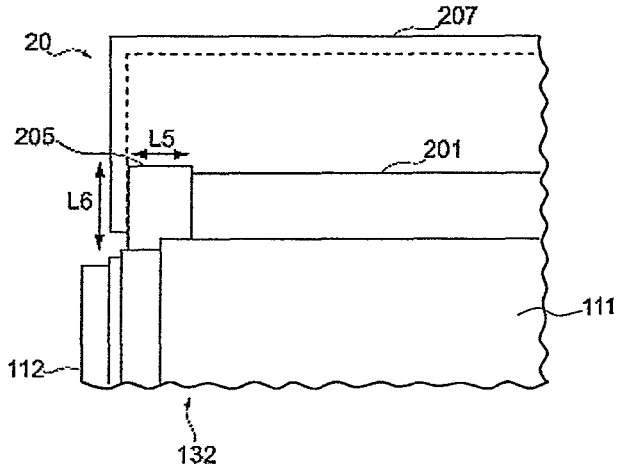
FIG. 2B is another diagram illustrating the cleaning section and the electrophotographic photosensitive member of the drum unit.
Figure 2C:
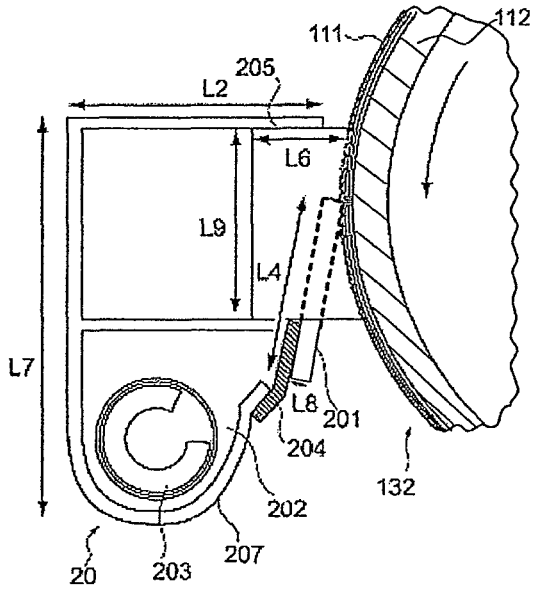
FIG. 2C is yet another diagram illustrating the cleaning section and the electrophotographic photosensitive member of the drum unit.

FIG. 2A is a top view of an embodiment of a drum unit as viewed from above the image-forming apparatus. FIG. 2B is an enlarged view of an end portion of the electrophotographic photosensitive member shown in FIG. 2A. FIG. 2C is a cross-sectional view of the drum unit as viewed from a lateral side of the image-forming apparatus. As shown in FIGS. 2A to 2C, the drum unit may include electrophotographic photosensitive member 132, cleaning blade 201, and side seals 205. The drum unit may remove the toner remaining on the surface of photosensitive layer 111 by causing cleaning blade 201 to abut the surface of photosensitive layer 111 of rotating electrophotographic photosensitive member 132.

A drum unit having such a structure may effectively scrape off toner remaining on the surface of photosensitive layer 111 despite its relatively simple configuration.

As shown in FIG. 2C, in some embodiments, a drum unit may discharge the residual toner scraped off by cleaning blade 201 to the outside of cleaning section 20. For example, residual toner may be discharged using an appropriate member, such as transfer screw 203, while storing residual toner in toner storage portion 202.

FIG. 2C depicts an upper end portion of cleaning blade 201 configured to make sliding contact with the surface of photosensitive layer 111 of electrophotographic photosensitive member 132. In some embodiments, angle member 204 having an L-shaped cross-section may be positioned between a lower end portion of cleaning blade 201 and casing 207 of cleaning section 20. In an embodiment, angle member 204 may extend along the width of electrophotographic photosensitive member 132. Angle members may be made from various materials including, but not limited to plastics such as composites (e.g., ABS (Acrylonitrile-Butadiene-Styrene)), polyamides, polyacetal polypropylene, metals such as stainless steel, aluminum, copper, any other materials known in the art, and/or combinations thereof.

In some embodiments, the cleaning blade may include one or materials including, but not limited to elastic materials, rubbers, such as urethane rubber, silicon rubber, fluorine rubber, chloroprene rubber, and butadiene rubber, any materials known in the art, and/or combinations thereof. For example, as shown in FIGS. 2A-2C, the main constituent of cleaning blade 201 may include a rubber elastic material, such as urethane rubber, silicon rubber, fluorine rubber, chloroprene rubber, and/or butadiene rubber.

In some embodiments, the length of cleaning section, "L1" may approximate the length of the base member of the electrophotographic photosensitive member, "k". In general, the length of cleaning section 20, L1 is in a range from about k−5 mm to about k+50 mm, where k is the length of the base member of the electrophotographic photosensitive member 132 in the axial direction. In some embodiments, this length may vary based on the length of the electrophotographic photosensitive member 132 in the axial direction.

A width "L2" of the cleaning section 20 is, in some embodiments, in a range from about 5 mm to about 50 mm. A height "L7" of cleaning section 20 is, in some embodiments, in a range from about 5 mm to about 50 mm.

A length "L3" of cleaning blade 201 may be in a range from about k-20 mm to about k mm. A width "L4" of cleaning blade 201 may be in a range from about 3 mm to about 20 mm. A thickness "L8" of the cleaning blade 201 may be in a range from about 1 mm to about 10 mm.

As shown in FIGS. 2A to 2C, cleaning blade 201 is provided with side seals 205 which inhibit (e.g., impede or reduce, and/or prevent or preclude) toner leakage at both end portions.

Figure 3A:
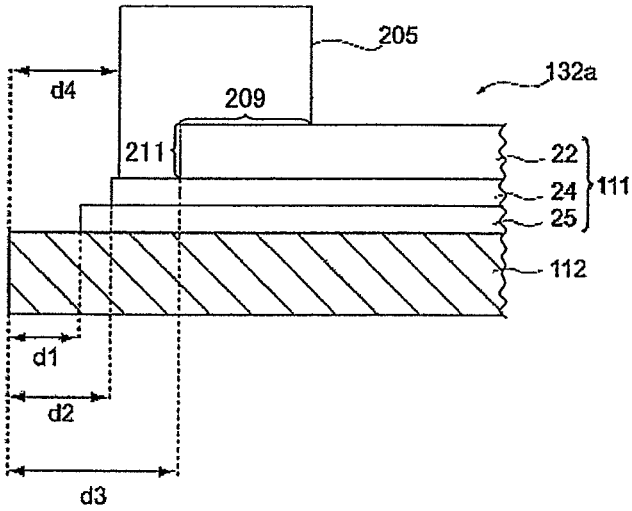
FIG. 3A is a drawing illustrating a cleaning section and an electrophotographic photosensitive member of a drum unit according to an embodiment of the present invention.
Figure 3B:
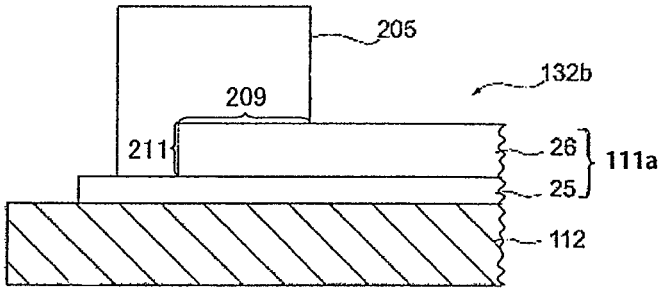
FIG. 3B is a drawing illustrating a cleaning section and an electrophotographic photosensitive member of a drum unit according to an embodiment of the present invention.

As shown in FIGS. 3A and 3B, at least one of side seals 205 disposed at the two ends of cleaning blade 201 is in contact with surface 209 and end face 211. Surface 209 and end face 211 are shown as portions of outermost layer (charge transport layer 22 or single layer-type photosensitive layer main body 26) of photosensitive layer 111 or 111*a* of electrophotographic photosensitive member 132*a*, 132*b*. For example, multilayer electrophotographic photosensitive member 132*a* shown in FIG. 3A and a single-layer electrophotographic photosensitive member 132*b* shown in FIG. 3B, may be collectively referred to as "electrophotographic photosensitive member 132".

Figure 3C:
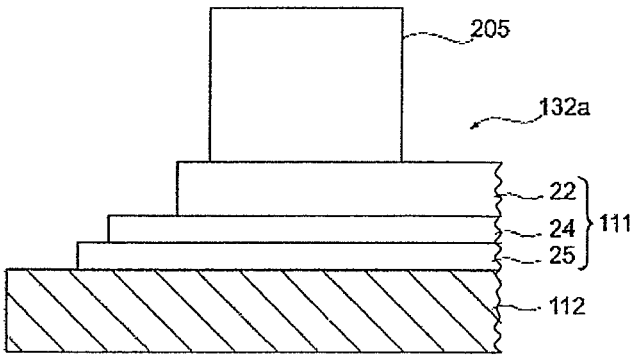
FIG. 3C is a drawing illustrating a cleaning section and an electrophotographic photosensitive member of a drum unit according to an embodiment of the present invention.

In some embodiments, by positioning the side seals such that the seals contact the surface and end face of the outermost layer, the interface between the side seals and the electrophotographic photosensitive member may be stabilized. For example, as shown in FIGS. 3A-3C, side seals 205 of cleaning section 20 are arranged such that the side seals contact surface 209 and end face 211 of outer most layer 22 or 26 of photosensitive layer 111 or 111*a* of electrophotographic photosensitive member 132. Using such an arrangement may allow the interface between the side seals 205 and electrophotographic photosensitive member 132 to be stabilized.

In embodiments utilizing the arrangement shown in FIGS. 3A-3C described above, curling and vibration of side seals 205 and/or slipping of the residual toner beneath side seal 205 may be inhibited. In some embodiments, positioning the side seals such that the side seals contact the surface and a face of the outermost layer may suppress both curling and vibration of the side seals and toner escaping beneath the side seals. As a result, toner scattering at the end portions of the cleaning blade may be substantially inhibited.

In some embodiments, by positioning the side seals in the cleaning section such that the seals contact the surface and end face of the outermost layer, the side seals may contact the photosensitive layer in three dimensions. For example, as shown in FIGS. 3A-3C, side seals 205 of cleaning section 20 are arranged such that the side seals contact surface 209 and end face 211 of outermost layer (charge transport layer 22 or single photosensitive layer main body 26) of photosensitive layer 111 or 111*a*. Using such an arrangement may allow the interface between the side seals 205 and electrophotographic photosensitive member 132 to occur in three dimensions.

As a result, compared to the cases where the contact is made in two dimensions as illustrated in FIG. 3C, stability of the interface between the side seals and the electrophotographic photosensitive member can be increased.

In some embodiments, the contact pressure between side seals 205 and surface 209 of the electrophotographic photosensitive member 132 when touching is in a range from about 0.0001 $N/mm^2$ to about 0.1 $N/mm^2$.

In some embodiments, applying a contact pressure to side seals 205, surface 209 and/or end face 211 may allow for closer contact at the interfaces between the side seals, surface and/or end face. For example, when using a contact pressure, the contact surface of each side seal 205, which is flat or substantially flat in general, may be more effectively brought into close contact with surface 209 and end face 211 of the outermost layer (e.g., charge transport layer 22 or single photosensitive layer main body 26) of photosensitive layer 111 or 111*a*.

The contact pressure that occurs when side seals 205 contact surface 209 of electrophotographic photosensitive member 132 may be in a range from about 0.0002 $N/mm^2$ to about 0.05 $N/mm^2$. In some embodiments, contact pressures in a range from about 0.0005 $N/mm^2$ to about 0.01 $N/mm^2$ may be applied to the side seals, a surface of electrophotographic photosensitive member, and/or an end face of the electrophotographic photosensitive member.

In some embodiments, side seals may be positioned such that they contact one or more surfaces of the electrophotographic photosensitive member. For example, the side seals may contact a surface of one or more layers of the electrophotographic photosensitive member.

In some embodiments, materials used in the side seals may include, but are not limited to foam, polyurethane, foamed polyurethane, any known sealing material or combinations thereof. For example, in an embodiment the main constituent material of the side seals may be a foamed polyurethane. In an embodiment, foamed polyurethane may inhibit curling and vibration of the side seals and slipping of the residual toner beneath the side seals.

In an embodiment, foamed polyurethane may have high adhesiveness to the cleaning blade and the photosensitive layer and a low frictional property.

In some embodiments, materials used in the side seals may include, but are not limited to polyamide resins, silicon resins, silicon rubber, fluorocarbon rubber, and butadiene rubber. For example, materials such as polyamide resins, silicon resins, silicon rubber, fluorocarbon rubber, and butadiene rubber may be used as the main constituent material of side seals 205 in an embodiment.

In some embodiments, the foam cell diameters of side seals 205 are in a range from about 10 μm to about 400 μm. In an embodiment, utilizing foam having cells with diameters in this range may allow the frictional force against the photosensitive layer 111 or 111*a* to be reduced, while the slipping of toner is inhibited. Some embodiments may include foam having foam cell diameters in a range from about 10 to about 200 μm. An embodiment may include foam having foam cell diameters in a range from about 10 to about 100 μm.

In some embodiments, the hardness of side seals may be selected to be within a predetermined range. Hardness may be evaluated using standards known in the art, for example, by transformation in response to pressure. In some embodiments, standards utilized may include, but are not limited to ASTM-D2240 standard, Japanese Industrial Standard (JIS)-A(K6301-1975), or other standards known in the art. For example, the hardness of side seals 205 may be in range from about 10° to about 95° (ASTM-D2240 standard) or in a range from about 10° to about 90° (Japanese Industrial Standard (JIS)-A(K6301-1975)).

In some embodiments, the hardness of the side seals may be chosen such that the side seals maintain sufficient wear resistance. An embodiment may include specifying a hardness of the side seals such that wear to the photosensitive layer may be inhibited, such as reduced or in some cases prevented. Some embodiments may include selecting a hardness of the side seals based on inhibiting wear of the photosensitive layer due to the side seals and maintaining a sufficient wear resistance for the side seals.

In some embodiments, the hardness of the side seals 205 may be in a range from about 15° to about 70° (JIS-A(K6301-1975)), and in some implementations may be in the range from about 20° to about 50° (JIS-A(K6301-1975)).

As shown in FIG. 2B, length L5 of each side seal 205 in the axial direction of electrophotographic photosensitive member 132 may be in a range from about 0.5 mm to about 10 mm. Thickness L6 of side seal 205 may be in a range from about 1 mm to about 20 mm. As shown in FIG. 2C, length L9 of side seal 205 in the circumferential direction of electrophotographic photosensitive member 132 may be in range from about 1 mm to about 40 mm.

Some embodiments may include side seals 205 fixed on casing 207 of cleaning section 20 independently from cleaning blade 201. An embodiment may include side seals coupled to the casing of the cleaning section. In some embodiments, side seals 205 are not directly fixed on cleaning blade 201.

In some embodiments, fixing side seals 205 on casing 207 of cleaning section 20 independently from the cleaning blade 201 may inhibit curling of side seals 205 and/or cleaning blade 201. When the side seals and the cleaning blade are integrated, the contact pressure against the surface of the electrophotographic photosensitive member may vary, which may cause the cleaning blade and/or the side seal to curl up.

In some embodiments, providing side seals which are independent from the cleaning blade may reduce and/or inhibit curl up of the side seals. For example, when side seals 205 are fixed on casing 207 as shown in FIGS. 2A to 2C, side seals 205 are independent from cleaning blade 201 and thus the curling of the side seals and/or cleaning blade may be inhibited.

In some embodiments, providing side seals which are independent from the cleaning blade may allow for control of the positions of abutment and the contact pressure between the side seals and the electrophotographic photosensitive member, and the curling of the side seals may be inhibited (e.g., reduced and/or precluded).

In some embodiments, methods for coupling the side seals to the casing may include, but are not limited to fixing with adhesive, adhesive tape, pocket designs configured to hold the side seal, or any other coupling method known in the art. For example, any method that can stably fix the side seals 205 onto the casing 207 may be employed, such as fixing with an adhesive or an adhesive tape or fixing by using a pocket or the like for containing the side seal 205 as shown in FIG. 2C.

In some embodiments, positioning of the side seals may inhibit (e.g., reduce and/or preclude) curling. For example, even when side seals 205 and cleaning blade 201 are integrated in an embodiment, curling may be inhibited when side seals 205 are placed at particular positions on the surface of electrophotographic photosensitive member 132.

In some embodiments, the electrophotographic photosensitive member of the may include a base member and a photosensitive layer on the base member, the photosensitive layer containing a charge generation agent, a charge transport agent, and a binding resin.

In some embodiments, as shown in FIG. 3A, the electrophotographic photosensitive member may be a multilayer electrophotographic photosensitive member. Electrophotographic photosensitive member 132*a* may include base member 112, charge generation layer 24, and charge transport layer 22 sequentially layered on base member 112. In some embodiments, electrophotographic photosensitive member 132*a* may be a single-layer including base member 112 and single-layer photosensitive layer 111*a* on base member 112 as shown in FIG. 3B.

As shown in FIGS. 3A and 3B, some embodiments may include intermediate layer 25 on base member 112.

Embodiments of the elements of multilayer electrophotographic photosensitive member will now be described.

As shown in FIG. 2C, in some embodiments, base member 112 may be any member that is cylindrical in shape. In an embodiment, base member 112 may have a particular electrical conductivity. Base members may be constructed from any material having a predetermined conductivity including, but not limited to metals or any other materials known in the art. For example, base members in one embodiment may be constructed from materials having an electrical conductivity in a range from about $0.1\times10^{-8}$ □m to about $10000\times10^{-8}$ □m. For example, in some embodiments base member 112 may be comprise a metal such as iron and/or aluminum.

In some embodiments, a base member having an outer diameter in a predetermined range may inhibit leakage of developer. In an embodiment, an outer diameter of the base member may be in range from about 10 mm to about 100 mm. Some embodiments may include base members having an outer diameter in a range from about 20 mm to about 90 mm. Embodiments may include base members having outer diameters in a range from about 30 mm to about 80 mm. In some embodiments, base members may have outer diameters in a range from about 40 mm to about 70 mm. Embodiments may include base members having outer diameters in a range from about 45 mm to about 60 mm.

Some embodiments may include base members having thicknesses (e.g., in the radial direction) in a range from about 0.3 mm to about 5 mm. In an embodiment, the thickness may be in a range from about 0.5 m to about 3 mm.

In some embodiments, intermediate layer 25 may be formed on base member 112 as shown in FIGS. 3A and 3B.

Providing an intermediate layer may inhibit separation of the charge generation layer or the photosensitive layer caused by pressure-contact with the side seal. For example, as shown in FIG. 3A, providing intermediate layer 25 may inhibit separation of charge generation layer 24 and/or photosensitive layer 111, 111*a* caused by pressure contact with side seal 205.

In some embodiments, the intermediate layer may improve the adhesiveness between the base member and the charge generation layer or the single photosensitive layer main body.

Embodiments of binding resin in the intermediate layer may include, but are not limited resins, such as polyamide resins and polyvinyl alcohol resins.

In some embodiments, intermediate layer 25 may include one or more additives, such as titanium oxide or alumina.

An embodiment of the base member may include a region in each end portion of the base member which is not coated with the intermediate layer. This uncoated region may have a width in a range from about 0.1 mm to about 10 mm. In some embodiments, adhesiveness between the layers at the end portions of the photosensitive may be increased when at least part of the end portion is uncoated. For example, adhesiveness between the layers at the end portions of the photosensitive layer 111 or 111*a* may increase when part of the end portion of base member is uncoated. In some embodiments, the uncoated region may not be coated with the charge generation layer, the charge transport layer, and/or the single photosensitive layer main body. In some embodiments, the region without an intermediate layer may be coated with one or more of layers, such as the charge generation layer, the charge transport layer, or the photosensitive layer main body.

In some embodiments, the region without an intermediate layer has a width in a range from about 0.5 mm to about 3 mm.

In some embodiments, the thickness of the intermediate layer may be in a range from about 0.1 μm to about 50 μm. In some implementations, intermediate layers may have a thickness in a range from about 0.5 μm to 30 μm.

As shown in FIG. 3A, in some embodiments, the photosensitive layer may include multilayer photosensitive layer 111 with each side seal 205 in contact with surface 209, end face 211 of charge transport layer 22, and surface of charge generation layer 24 in relation to cleaning section 20.

In some embodiments, the interface between side seals and the surfaces of the electrophotographic photosensitive member may be stabilized. An embodiment may include inhibiting separation of the charge transport layer caused by press-contact with the side seal.

In some embodiments, the base member may have multiple regions which are coated with different layers. Some embodiments may include regions which have not been coated with charge generation layer and/or charge transport layer. For example, to provide a contact between the side seal 205 and the surface and/or the end face of the charge transport layer 22 and the surface of charge generation layer 24, at least in one end portion of base member 112, uncoated width d2 of a region not coated with charge generation layer 24 must be smaller than uncoated width d3 of a region not coated with charge transport layer 22.

When charge generation layer 24 and the charge transport layer 22 are applied, the adhesiveness between these layers at the end portions of the photosensitive layer 111 can be improved compared to when the above-described arrangement is not made. As a result, separation between these layers can be effectively suppressed. The width of the region in the end portion of base member 112 not coated with the charge generation layer 24 may be in range from about 0.01 mm to 10 mm. In some implementations, the width of the region in the end portion of base member not coated with the charge generation layer may be in a range from about 0.1 mm to about 5 mm.

In some embodiments, the width of the region in the end portion of the base member 112 not coated with the charge transport layer 22 may be in a range from about 0.01 mm to 20 mm. In some embodiments, the width of the region in the end portion of the base member not coated with the charge transport layer may be in a range from about 0.5 mm to 10 mm.

Figure 4A:
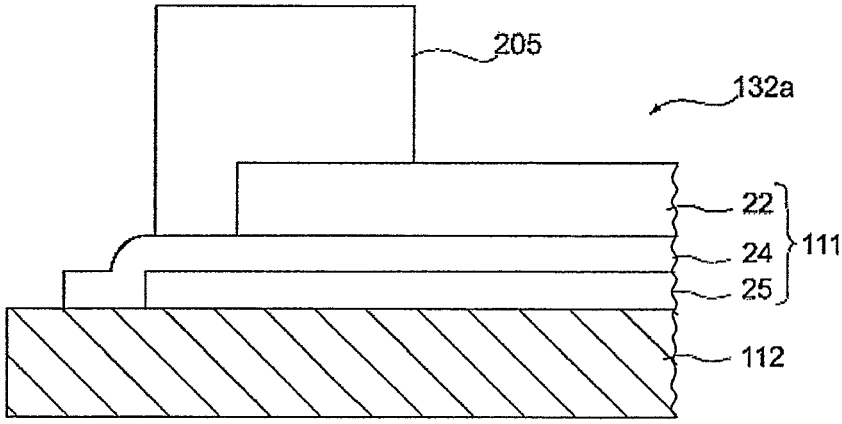
FIG. 4A is a drawing illustrating a cleaning section and an electrophotographic photosensitive member of a drum unit according to an embodiment of the present invention.
Figure 4B:
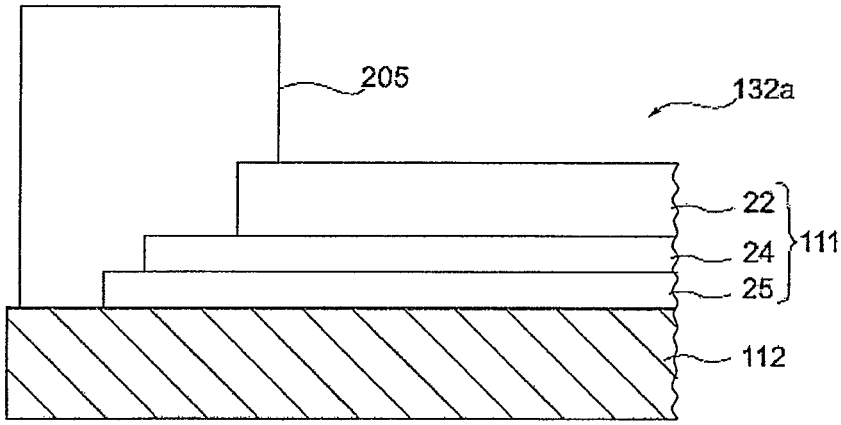
FIG. 4B is a drawing illustrating a cleaning section and an electrophotographic photosensitive member of a drum unit according to an embodiment of the present invention.

As shown in FIG. 4A, an embodiment may include charge generation layer 24 applied to a larger width than intermediate layer 25. Thus, an embodiment may include charge generation layer 24 in direct contacts with base member 112 at an end portion of the base member 112. As depicted in FIG. 4B, an embodiment may include shifting the position of side seal 205 outward so that side seal 205 directly contacts base member 112 at an end portion of base member 112.

In some embodiments, the binding resin used in the charge generation layer may include, but is not limited to polycarbonate resins, polyester resins, methacryl resins, acryl resins, polyvinyl chloride resins, polystyrene resins, polyvinyl acetal resins, other materials known in the art, or combinations thereof.

In some embodiments, polyvinyl acetal resins may be used as the binding resin.

In an embodiment having charge generation layer 24 including a polyvinyl acetal resin, separation of charge transport layer 22 caused by pressure-contact with the side seal 205 can be further effectively suppressed although this depends on the binding resin contained in the charge transport layer 22.

In some embodiments, the charge generation agent in the charge generation layer 24 may include, but is not limited to phthaloeyanine pigments, perylene pigments, bisazo pigments, other pigments known in the art and/or combinations thereof.

An embodiment may include charge generation layer 24 which has a content of charge generation agent in a range of about 5 to about 1000 parts by weight relative to 100 parts by weight of binding resin in the charge generation layer 24.

In some embodiments, the thickness of the charge generation layer may be in a range from about 0.02 μm to about 1.7 μm. Some embodiments may include a thickness of the charge generation layer in a range from about 0.03 μm to 1.5 μm.

In some embodiments, the binding resin used in the charge transport layer may include, but is not limited to acryl resins, polyarylate resins, polyester resins, polycarbonate resins, polystyrene resins, other materials known in the art, or combinations thereof.

In some embodiments, polyarylate resins and polycarbonate resins may be utilized as the binding resin.

In some embodiments, using a polyarylate resin or a polycarbonate resin in charge transport layer 22 may improve the adhesiveness between layers and separation of the charge transport layer 22 caused by press contact of the side seal 205 can be further effectively suppressed. In an embodiment, when charge generation layer 24 includes a polyvinyl acetal resin as the binding resin, the adhesiveness between layers may improve and separation of charge transport layer 22 caused by press contact of side seal 205 can be further effectively suppressed.

In some embodiments, the charge transport agent used in the charge transport layer may include, but is not limited to hole transport agents, such as oxadiazole derivatives, pyrazoline derivatives, aromatic tertiary amine compounds, and hydrazone derivatives and electron transport agents, such as quinone compounds, fluorenone compounds, diphenoquinone compounds, other materials known in the art and/or combinations thereof.

In an embodiment, the charge transport agent content may be in the range from about 20 to about 500 parts by weight relative to 100 parts by weight of the binding resin in the charge transport layer.

In some embodiments, the thickness of charge transport layer 22 may be in a range from about 5 μm to about 50 μm. In an embodiment, the thickness of charge transport layer may be in a range from about 10 μm to 40 μm.

Methods for forming the individual layers described above are not particularly limited and any appropriate method known in the art may be employed.

In simple terms, constituent materials for individual layers may each be dissolved or dispersed in an organic solvent, such as tetrahydrofuran, to prepare coating solutions. In some embodiments, the coating solutions may be applied on a base member one by one and dried.

In some embodiments, methods for applying the coating solutions may include, but are not limited to dip-coating methods, spray-coating methods, bead-coating methods, blade-coating methods, and roller-coating methods.

In an embodiment, the electrophotographic photosensitive member of the may include a single-layer electrophotographic photosensitive member. The same fabrication method as in the case of fabricating the multilayer electrophotographic photosensitive member may be used, except that the single photosensitive layer main body including both a charge generation agent and a charge transport agent is formed on the base member or the intermediate layer.

In some embodiments, the hole transport agent content may be in a range from about 20 to about 120 parts by weight relative to 100 parts by weight of the binding resin. An embodiment may include an electron transport agent content in a range from about 10 to about 70 parts by weight relative to 100 parts by weight of the binding resin. Some embodiments may include a charge generation agent content may be in a range from about 0.2 to about 40 parts by weight relative to 100 parts by weight of the binding resin.

In some embodiments, the thickness of the photosensitive layer 111*a* may be in a range from about 5 μm to about 100 μm. An embodiment may include a photosensitive layer having a thickness in a range from about 15 μm to about 45 μm.

EXAMPLES

Embodiments will now be described in detail using illustrative examples. These examples are illustrative only and are not intended to limit the scope of the claims in any manner.

Example 1

1. Preparation of a Cleaning Section

Cleaning section 20 shown in FIGS. 2A to 2C was prepared. The details of preparation are described below.

The side seals 205 were fixed onto the casing 207 by using a double-sided adhesive tape.

Side Seal
- Main constituent material: foamed polyurethane (cell diameter: 50 μm)
- Hardness: 20° (JIS-A)
- Length L5 in the axial direction of the electrophotographic photosensitive member: 2 mm
- Thickness L6: 8 mm
- Length L9 in the circumferential direction of electrophotographic photosensitive member: 12 mm
- Contact pressure against the surface of the electrophotographic photosensitive member: 0.001 $N/mm^2$ Cleaning Blade
- Main constituent material: polyurethane rubber
- Hardness: 60° (JIS-A)
- Length L3: 238 mm
- Width L4: 12 mm
- Thickness L8: 2 mm
- Contact pressure against the surface of the electrophotographic photosensitive member: 15 $N/m^2$ 2. Fabrication of Multilayer Electrophotographic Photosensitive Member (a) Formation of Intermediate Layer 25

Into a container, 200 parts by weight of titanium oxide (SMT-02 produced by Tayca Corporation, number-average primary particle diameter: 10 nm) surface-treated with alumina and silica first and then with methyl hydrogen polysiloxane while being wet-dispersed, 1000 parts by weight of methanol, 200 parts by weight of n-butanol, and 100 parts by weight of a copolymerized polyamide resin (Amilan CM8000 produced by Toray Industries, Inc.) were added. Then the resulting mixture was mixed and dispersed in a bead mill for 5 hours and filtered with a 5-μm filter to prepare a coating solution for the intermediate layer.

While placing the base member 112, which was an aluminum base member (support substrate) 30 mm in diameter and 246 mm in length, with one end up, the base member 112 was immersed in the solution for the intermediate layer and withdrawn at a rate of 5 mm/sec (dip-coating). Then the solution was cured at 130° C. for 30 minutes to form an intermediate layer 25 having a thickness of 2 μm.

Here, the uncoated width d1 of the region in an upper end, i.e., an end on the upper side during dip coating, of the base member 112 not coated with the intermediate layer 25 was 0.5 mm.

(b) Formation of Charge Generation Layer

Next, into a container, 100 parts by weight of titanyl phthalocyanine crystals serving as a charge generation agent, 100 parts by weight of a polyvinyl acetal resin (Denka Butyral #6000EP produced by Denki Kagaku Kogyo Kabushiki Kaisha) serving as a binding resin, and 4000 parts by weight of tetrahydrofuran and 4000 parts by weight of propylene glycol monomethyl ether serving as dispersion media were added. The resulting mixture was dispersed in a bead mill for 2 hours and filtered with a 3 μm filter to prepare a coating solution for the charge generation layer.

Next, the coating solution for the charge generation layer was applied on the intermediate layer 25 by dip-coating and dried at 50° C. for 5 minutes to fabricate a charge generation layer 24 having a thickness of 0.3 μm.

Here, the uncoated width d2 of the region in an upper end, i.e., an end on the upper side during dip coating, of the base member 112 not coated with the charge generation layer 24 was 0.6 mm.

(c) Formation of Charge Transport Layer

Next, into a container, 70 parts by weight of an enamine hydrazone compound (HTM-1) represented by formula (1) below serving as a hole transport agent, 5 parts by weight of di-tert-butyl-p-cresol (YOSHINOX BHT produced by API Corporation), 100 parts by weight of a polycarbonate resin (Resin-1) having a viscosity-average molecular weight of 30,500 and being represented by formula (2) below serving as a binder resin, and 600 parts by weight of tetrahydrofuran serving as a solvent were placed:

(1)

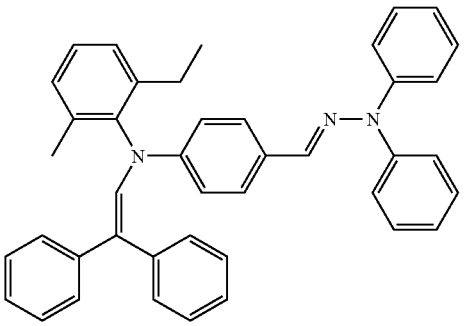

(HTM-1)

-continued (2)

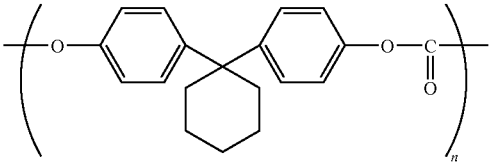

(Resin-1)

The resulting mixture was dispersed for 10 minutes using an ultrasonic disperser to prepare a coating solution for the charge transport layer.

The coating solution for the charge transport layer was applied on the charge generation layer 24 by the same method as with the coating solution for the charge generation layer and dried at 130° C. for 30 minutes to form a charge transport layer 22 having a thickness of 20 μm.

Here, the uncoated width d3 of the region in an upper end, i.e., an end on the upper side during dip coating, of the base member 112 not coated with the charge transport layer 22 was 2.8 mm.

Lastly, a flange was inserted into the upper end of the multilayer electrophotographic photosensitive member 132*a* and a gear flange was inserted into a lower part of the multilayer electrophotographic photosensitive member 132*a* to complete fabrication of the multilayer electrophotographic photosensitive member 132*a*.

3. Evaluation

The cleaning section 20 and the multilayer electrophotographic photosensitive member 132*a* prepared as such were loaded into a commercially available image-forming apparatus (c5800n produced by Oki Data Corporation) that employs a negative charge reversal development process to conduct evaluation of toner scattering.

In particular, the cleaning section 20 and the multilayer electrophotographic photosensitive member 132*a* were placed so that portions of the base member 112, which were 1 to 3 mm from the upper and lower ends of the base member 112, were in pressure-contact with the side seals 205 (i.e., the position of each side seal from the corresponding end was set such that d4 was 1 to 3 mm).

A 60-mm portion of an A4-size paper sheet was cut off from one edge perpendicular to the long axis direction. The resulting paper sheet was placed on a paper feed tray of the image-forming apparatus so that the cut-off portion would have been positioned at the upper end side of the multilayer electrophotographic photosensitive member 132*a*.

Next, a particular A4-sized image was continuously printed on 500 sheets at a temperature of 32° C. and a relative humidity of 85% to test durability. The A4-size image used here contained a solid image occupying a 10-mm-wide region corresponding to the upper end of the multilayer electrophotographic photosensitive member 132*a*, i.e., a 10-mm-wide region at which the cut-off portion of the paper sheet would have been positioned.

In other words, the image was continuously printed on 500 paper sheets to test durability so that the toner was not transferred onto the paper sheet at the upper end portion of the multilayer electrophotographic photosensitive member 132*a* and that all of the development toner served as the residual toner.

Next, whether toner fusion occurred at the upper end portion of the multilayer electrophotographic photosensitive member 132*a* due to toner scattering was checked.

After printing was continuously performed on additional 1500 paper sheets to test durability, i.e., after printing had been performed on a total of 2000 sheets, whether toner fusion occurred at the upper end portion of the multilayer electrophotographic photosensitive member 132*a* due to toner scattering was confirmed in the same manner. Evaluation was made according to the criteria below:

A: no toner fusion was found

F: toner fusion was found

The results are shown in Table 1.

After printing had been performed on 2000 sheets, whether separation of the photosensitive layer 111 occurred at the upper end portion of the multilayer electrophotographic photosensitive member 132*a* was visually investigated and evaluation was made according to the criteria below:

A: no separation of the photosensitive layer 111 was observed

F: minor separation of the photosensitive layer 111 was observed in a portion that contacted the side seal 205

The results are shown in Table 1.

Example 2

In EXAMPLE 2, an image-forming apparatus was made as in EXAMPLE 1 except that in making the multilayer electrophotographic photosensitive member 132*a*, the uncoated width d1 of the region not coated with the intermediate layer 25 was changed to 3.0 mm. Evaluation was then conducted, results of which are shown in Table 1.

Example 3

In EXAMPLE 3, an image-forming apparatus was made as in EXAMPLE 1 except that in making the multilayer electrophotographic photosensitive member 132*a*, the uncoated width d2 of the region not coated with the charge generation layer 24 was changed to 3.5 mm. Evaluation was then conducted, results of which are shown in Table 1.

Example 4

In EXAMPLE 4, an image-forming apparatus was made as in EXAMPLE 1 except that in making the multilayer electrophotographic photosensitive member 132*a*, the uncoated width d1 of the region not coated with the intermediate layer 25 was changed to 3.5 mm and the uncoated width d2 of the region not coated with the charge generation layer 24 was changed to 3.5 mm. Evaluation was then conducted, results of which are shown in Table 1.

Example 5

In EXAMPLE 5, an image-forming apparatus was made as in EXAMPLE 1 except that in making the multilayer electrophotographic photosensitive member 132*a*, the uncoated width d2 of the region not coated with the charge generation layer 24 was changed to 2.0 mm. Evaluation was then conducted, results of which are shown in Table 1.

Example 6

In EXAMPLE 6, an image-forming apparatus was made as in EXAMPLE 1 except that in making the multilayer electrophotographic photosensitive member 132*a*, the uncoated width d1 of the region not coated with the intermediate layer 25 was changed to 1.5 mm and the uncoated width d2 of the region not coated with the charge generation layer 24 was changed to 2.0 mm. Evaluation was then conducted, results of which are shown in Table 1.

Example 7

In EXAMPLE 7, an image-forming apparatus was made as in EXAMPLE 1 except that in making the multilayer electrophotographic photosensitive member 132*a*, the binding resin in the charge transport layer 22 was changed to a polyarylate resin (Resin-2) having a viscosity-average molecular weight of 50,000 and being represented by formula (3) below:

(3)

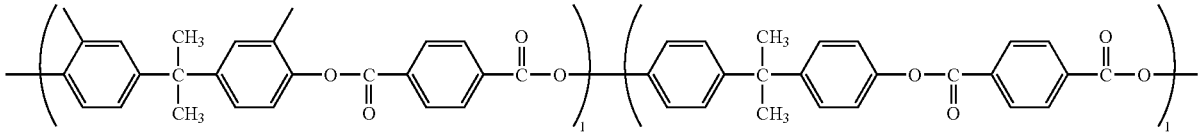

(Resin-2)

Evaluation was conducted, results of which are shown in Table 1.

Example 8

In EXAMPLE 8, an image-forming apparatus was made as in EXAMPLE 7 except that in making the multilayer electrophotographic photosensitive member 132*a*, the uncoated width d1 of the region not coated with the intermediate layer 25 was changed to 1.5 mm and the uncoated width d2 of the region not coated with the charge generation layer 24 was changed to 2.0 mm. Evaluation was then conducted, results of which are shown in Table 1.

Comparative Example 1

In COMPARATIVE EXAMPLE 1, an image-forming apparatus was made as in EXAMPLE 1 except that in making the multilayer electrophotographic photosensitive member 132*a*, the uncoated width d3 of the region not coated with the charge transport layer 22 was changed to 0.7 mm. Evaluation was then conducted, results of which are shown in Table 1.

Comparative Example 2

In COMPARATIVE EXAMPLE 2, an image-forming apparatus was made as in EXAMPLE 1 except that in making the multilayer electrophotographic photosensitive member 132*a*, the uncoated width d3 of the region not coated with the charge transport layer 22 was changed to 3.5 mm. Evaluation was then conducted, results of which are shown in Table 1.

Comparative Example 3

In COMPARATIVE EXAMPLE 3, an image-forming apparatus was made as in EXAMPLE 1 except that in making the multilayer electrophotographic photosensitive member 132*a*, the uncoated width d1 of the region not coated with the intermediate layer 25 was changed to 4.0 mm, the uncoated width d2 of the region not coated with the charge generation layer 24 was changed to 4.5 mm, and the uncoated width d3 of the region not coated with the charge transport layer 22 was changed to 5.0 mm. Evaluation was then conducted, results of which are shown in Table 1.

TABLE 1

| | UNCOATED WIDTH OF REGION IN AN UPPER END (mm) | | | POSITION OF A SIDE SEAL FROM (AN UPPER) END [d4] (mm) | CONTACT WITH A SIDE SEAL IN AN UPPER END | | |
|---|---|---|---|---|---|---|---|
| | INTERMEDIATE LAYER [d1] | CHARGE GENERATION LAYER [d2] | CHARGE TRANSPORT LAYER [d3] | | BASE MEMBER | INTERMEDIATE LAYER | CHARGE GENERATION LAYER |
| EXAMPLE 1 | 0.5 | 0.5 | 2.8 | 1~3 | F | F | A |
| EXAMPLE 2 | 3.0 | | | | F | F | A |
| EXAMPLE 3 | 0.5 | 3.5 | | | F | A | F |
| EXAMPLE 4 | 3.5 | | | | A | F | F |
| EXAMPLE 5 | 0.5 | 2.0 | | | F | A | A |
| EXAMPLE 6 | 1.5 | | | | A | A | A |
| EXAMPLE 7 | 0.5 | 0.6 | | | F | F | A |
| EXAMPLE 8 | 1.5 | 2.0 | | | F | F | A |
| COMPARATIVE EXAMPLE 1 | 0.5 | 0.6 | 0.7 | | F | F | F |
| COMPARATIVE EXAMPLE 2 | | | 3.5 | | F | F | A |
| COMPARATIVE EXAMPLE 3 | | 3.5 | | | F | A | F |
| COMPARATIVE EXAMPLE 4 | 4.0 | 4.5 | 5.0 | | A | F | F |

| | CONTACT WITH A SIDE SEAL IN AN UPPER END CHARGE TRANSPORT LAYER | | BINDING RESIN CONTAINED IN THE CHARGE TRANSPORT LAYER | EVALUATION | | |
|---|---|---|---|---|---|---|
| | | | | EVALUATION OF TONER SCATTERING | | |
| | END FACE | SURFACE | | TONER FUSION AFTER 500 SHEETS PRINTING TO TEST DURABILITY | TONER FUSION AFTER 2000 SHEETS PRINTING TO TEST DURABILITY | EVALUATION OF SEPARATION |
| EXAMPLE 1 | A | A | Resin-1 | A | A | A |
| EXAMPLE 2 | A | A | | A | A | A |
| EXAMPLE 3 | A | A | | A | F | F |
| EXAMPLE 4 | A | A | | A | F | F |
| EXAMPLE 5 | A | A | | A | A | A |
| EXAMPLE 6 | A | A | | A | A | A |
| EXAMPLE 7 | A | A | Resin-2 | A | A | A |
| EXAMPLE 8 | A | A | | A | A | A |
| COMPARATIVE EXAMPLE 1 | F | A | Resin-1 | F | F | F |
| COMPARATIVE EXAMPLE 2 | F | F | | F | F | A |
| COMPARATIVE EXAMPLE 3 | F | F | | F | F | A |
| COMPARATIVE EXAMPLE 4 | F | F | | F | F | A |

132*a*, the uncoated width d2 of the region not coated with the charge generation layer 24 was changed to 3.5 mm and the uncoated width d3 of the region not coated with the charge transport layer 22 was changed to 3.5 mm. Evaluation was then conducted, results of which are shown in Table 1.

Comparative Example 4

In COMPARATIVE EXAMPLE 4, an image-forming apparatus was made as in EXAMPLE 1 except that in making Example 9

1. Fabrication of Multilayer Electrophotographic Photosensitive Member

In EXAMPLE 9, the multilayer electrophotographic photosensitive member 132*a* was fabricated as in EXAMPLE 1 and a lower end portion of the base member 112, i.e., the end portion that comes at the lower side during dip-coating, was subjected to a lower end treatment. In particular, the lower end of the multilayer electrophotographic photosensitive member 132*a* was immersed by 2.5 mm in a tetrahydrofuran/ toluene mixed solvent so as to remove only the charge transport layer 22, i.e., the outermost layer, by 2.5 mm from the lower end.

The multilayer electrophotographic photosensitive member 132*a* was fabricated as in EXAMPLE 1 except for the treatment described above. In other words, the lower end portion of the base member 112 was processed such that the width (removed width) d11 of the removed portion of the intermediate layer 25 was 0 mm, the width (removed width) d12 of the removed portion of the charge generation layer 24 was 0 mm, and the width (removed width) d13 of the removed portion of the charge transport layer 22 was 2.5 mm.

2. Evaluation

The multilayer electrophotographic photosensitive member 132*a* fabricated as above and the cleaning section 20 prepared in EXAMPLE 1 were loaded into a commercially available image-forming apparatus (c5800n produced by Oki Data Corporation) that employs a negative charge reversal development process to conduct evaluation of toner scattering.

Printing was performed on 500 sheets and 2000 sheets as in EXAMPLE 1 except that the partially cut A4-size paper was placed on a paper feed tray of the image-forming apparatus so that the cut-off portion would have been positioned at the lower end of the multilayer electrophotographic photosensitive member 132*a*.

Then whether toner fusion occurred at the lower end portion of the multilayer electrophotographic photosensitive member 132*a* due to toner scattering was checked. The results are shown in Table 2.

After printing had been performed on a total of 2000 sheets, whether separation of the photosensitive layer 111 occurred at the lower end portion of the multilayer electrophotographic photosensitive member 132*a* was visually investigated. The results are shown in Table 2.

Example 10

In EXAMPLE 10, an image-forming apparatus was made as in EXAMPLE 9 except that, in making the multilayer electrophotographic photosensitive member 132*a*, the intermediate layer 25 was removed by 3.0 mm from the lower end by the lower end treatment so that the removed width d11 was 3.0 mm. Evaluation was then conducted, results of which are shown in Table 2.

Example 11

In EXAMPLE 11, an image-forming apparatus was made as in EXAMPLE 9 except that, in making the multilayer electrophotographic photosensitive member 132*a*, the charge generation layer 24 was removed by 5.0 mm from the lower end by the lower end treatment so that the removed width d12 was 5.0 mm. Evaluation was then conducted, results of which are shown in Table 2.

Example 12

In EXAMPLE 12, an image-forming apparatus was made as in EXAMPLE 9 except that, in making the multilayer electrophotographic photosensitive member 132*a*, the intermediate layer 25 and the charge generation layer 24 were each removed by 5.0 mm from the lower end by the lower end treatment so that the removed width d11 was 5.0 mm and the removed width d12 was 5.0 mm. Evaluation was then conducted, results of which are shown in Table 2.

Comparative Example 5

In COMPARATIVE EXAMPLE 5, an image-forming apparatus was made as in EXAMPLE 9 except that, in making the multilayer electrophotographic photosensitive member 132*a*, no lower end treatment was performed (removed width d11=removed width d12=removed width d13=0 mm). Evaluation was then conducted, results of which are shown in Table 2.

Comparative Example 6

In COMPARATIVE EXAMPLE 6, an image-forming apparatus was made as in EXAMPLE 9 except that, in making the multilayer electrophotographic photosensitive member 132*a*, the charge generation layer 24 and the charge transport layer 22 were removed by 5.0 mm from the lower end by the lower end treatment so that removed width d12 was 5.0 mm and the removed width d13 was 5.0 mm. Evaluation was then conducted, results of which are shown in Table 2.

Comparative Example 7

In COMPARATIVE EXAMPLE 7, an image-forming apparatus was made as in EXAMPLE 9 except that, in making the multilayer electrophotographic photosensitive member 132*a*, the intermediate layer 25, the charge generation layer 24, and the charge transport layer 22 were removed by 5.0 mm from the lower end by the lower end treatment so that removed width d11=removed width d12=removed width d13=10 mm. Evaluation was then conducted, results of which are shown in Table 2.

TABLE 2

| | REMOVED WIDTH OF REGION IN A LOWER END (mm) | | | POSITION OF A SIDE SEAL FROM (A LOWER) END [d4] (mm) | CONTACT WITH A SIDE SEAL IN AN LOWER END | | |
|---|---|---|---|---|---|---|---|
| | INTERMEDIATE LAYER [d1] | CHARGE GENERATION LAYER [d2] | CHARGE TRANSPORT LAYER [d3] | | BASE MEMBER | INTERMEDIATE LAYER | CHARGE GENERATION LAYER |
| EXAMPLE 9 | 0.0 | 0.0 | 2.5 | 1~3 | F | F | A |
| EXAMPLE 10 | 3.0 | | | | F | F | A |
| EXAMPLE 11 | 0.0 | 5.0 | | | F | A | F |
| EXAMPLE 12 | 5.0 | | | | A | F | F |
| COMPARATIVE EXAMPLE 5 | 0.0 | 0.0 | 0.0 | | F | F | F |
| COMPARATIVE EXAMPLE 6 | | 5.0 | 5.0 | | F | A | F |

TABLE 2-continued

| | | | | | | |
|---|---|---|---|---|---|---|
| COMPARATIVE EXAMPLE 7 | 5.0 | | | A | F | F |

| | CONTACT WITH A SIDE SEAL IN A LOWER END CHARGE TRANSPORT LAYER | | BINDING RESIN CONTAINED IN THE CHARGE TRANSPORT | EVALUATION | | |
|---|---|---|---|---|---|---|
| | | | | EVALUATION OF TONER SCATTERING | | |
| | END FACE | SURFACE | LAYER | TONER FUSION AFTER 500 SHEETS PRINTING TO TEST DURABILITY | TONER FUSION AFTER 2000 SHEETS PRINTING TO TEST DURABILITY | EVALUATION OF SEPARATION |
| EXAMPLE 9 | A | A | Resin-1 | A | A | A |
| EXAMPLE 10 | A | A | | A | A | A |
| EXAMPLE 11 | A | A | | A | F | F |
| EXAMPLE 12 | A | A | | A | F | F |
| COMPARATIVE EXAMPLE 5 | F | A | | F | F | F |
| COMPARATIVE EXAMPLE 6 | F | F | | F | F | A |
| COMPARATIVE EXAMPLE 7 | F | F | | F | F | A |

Having thus described in detail embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A drum unit comprising:

an electrophotographic photosensitive member comprising:

a base member; and a photosensitive layer proximate a surface of the base member;

a cleaning blade configured to abut at least a portion of a surface of the photosensitive layer and to remove a developer remaining on the photosensitive layer; and a side seal disposed at each end of the cleaning blade to inhibit leakage of the developer, wherein the photosensitive layer is not disposed at an end portion of the surface of the base member, and at least one of the side seals is in contact with (i) a surface region of said surface of the photosensitive layer, the surface region facing a direction faced by the portion of the surface abutted by the cleaning blade, and (ii) an end portion of the photosensitive layer, the end portion facing a direction different from the direction faced by said surface region.

2. The drum unit according to claim 1, wherein the side seals comprise foamed polyurethane.

3. The drum unit according to claim 1, wherein the side seals have a hardness in a range from about 10° to about 95° according to ASTM-D2240 standard.

4. The drum unit according to claim 1, further comprising a casing onto which the side seals and the cleaning blade are independently coupled.

5. The drum unit according to claim 1, wherein the photosensitive layer comprises:

a charge generation layer on the base member;

a charge transport layer on the charge generation layer, and at least one of the side seals is in contact with a surface region of a surface and an end face of the charge transport layer and a surface region of a surface of the charge generation layer.

6. The drum unit according to claim 5, wherein the charge generation layer comprises a polyvinyl acetal and the charge transport layer comprises a polyarylate resin or a polycarbonate resin.

7. The drum unit according to claim 5, further comprising an intermediate layer interposed between the base member and the photosensitive layer, the intermediate layer thereby having a surface disposed toward the photosensitive layer and another surface disposed toward the base member.

8. The drum unit according to claim 7, wherein a width of the end portion of the surface of the base member that is uncoated by the charge generation layer is smaller than a width of the end portion of the base member that is uncoated by the intermediate layer.

9. The drum unit according to claim 7, wherein at least one of the side seals is in contact with a surface region of said surface of the intermediate layer and with an end portion of the charge generation layer.

10. The drum unit according to claim 1, wherein said end portion of the photosensitive layer comprises an end face of the photosensitive layer.

11. An image-forming apparatus comprising:

an electrophotographic photosensitive member comprising a base member and a photosensitive layer proximate a surface of the base member;

a charging portion configured to charge the electrophotographic photosensitive member;

an exposing portion configured to form an electrostatic latent image on the electrophotographic photosensitive member by exposing the electrophotographic photosensitive member charged by the charging portion;

a developing portion configured to form a developer image on the electrophotographic photosensitive member by developing with a developer the electrostatic latent image formed on the electrophotographic photosensitive member by the exposing portion;

a transferring portion configured to transfer the developer image formed on the electrophotographic photosensitive member by the developing portion onto a recording medium;

a cleaning blade configured to abut at least a portion of a surface of the photosensitive layer and to remove a developer remaining on the photosensitive layer during use; and a side seal disposed at each end of the cleaning blade to inhibit leakage of the developer, wherein the photosensitive layer is not disposed at an end portion of the surface of the base member, and at least one of the side seals is in contact with (i) a surface region of said surface of the photosensitive layer, the surface region facing a direction faced by the portion of the surface abutted by the cleaning blade, and (ii) an end portion of the photosensitive layer, the end portion facing a direction different from the direction faced by said surface region.

12. The image forming apparatus according to claim 11, wherein said end portion of the photosensitive layer comprises an end face of the photosensitive layer.

* * * * *